US007153640B1

(12) United States Patent
Zengerle et al.

(10) Patent No.: US 7,153,640 B1
(45) Date of Patent: Dec. 26, 2006

(54) SILVER HALIDE LIGHT-SENSITIVE ELEMENT

(75) Inventors: Paul L. Zengerle, Rochester, NY (US); Christopher J. Haller, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/261,047

(22) Filed: Oct. 28, 2005

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/46*** | (2006.01) |
| ***G03C 1/005*** | (2006.01) |

(52) U.S. Cl. ..... 430/546; 430/502; 430/503; 430/543; 430/551; 430/552; 430/553; 430/567; 430/631

(58) Field of Classification Search ..... 430/502, 430/503, 543, 546, 551, 552, 553, 567, 631
See application file for complete search history.

(56) References Cited

U.S. PATENT DOCUMENTS

| | | | | |
|---|---|---|---|---|
| 2,322,027 | A | 6/1943 | Jelley et al. | |
| 4,731,320 | A * | 3/1988 | Sasaki et al. | 430/505 |
| 5,429,913 | A * | 7/1995 | Merkel et al. | 430/546 |
| 5,726,003 | A | 3/1998 | Zengerle et al. | |
| 6,221,571 | B1 | 4/2001 | Zengerle et al. | |
| 6,680,165 | B1 | 1/2004 | Poslusny et al. | |

* cited by examiner

*Primary Examiner*—Geraldine Letscher
(74) *Attorney, Agent, or Firm*—Anderson J. Anderson

(57) ABSTRACT

A silver halide light sensitive photographic element comprising a support bearing at least one cyan image forming hydrophilic colloid layer comprising cyan image dye forming coupler of Formula I and a saturated alcoholic high boiling solvent or mixture of solvents of Formula II:
Formula I wherein $R_1$ is an alkyl group, $R_2$ is a ballast group, and X is hydrogen or a coupling-off group;
Formula II wherein $R_3$ represents an alkyl group, and $R_4$ and $R_5$ individually represent hydrogen or an alkyl group, or $R_3$ and $R_4$ may be joined to form a cycloalkyl group, provided that the total number of carbon atoms contained in $R_3$, $R_4$, and $R_5$ is at least 10 and that the alcoholic solvent or mixture of solvents of Formula II is liquid at 37° C.

18 Claims, No Drawings

SILVER HALIDE LIGHT-SENSITIVE ELEMENT

TECHNICAL FIELD

This invention relates to the field of silver halide light-sensitive elements, and in particular to photographic elements having at least one layer containing a cyan dye forming coupler and a saturated alcoholic coupler solvent. In a particular aspect, it relates to motion picture print films.

BACKGROUND OF THE INVENTION

Various techniques are known for dispersing hydrophobic photographically useful compounds such as photographic couplers into photographic element layer coating compositions comprising hydrophilic colloids.

Photographic dye forming couplers, as well as other hydrophobic photographically useful compounds, are typically incorporated into a hydrophilic colloid layer of a photographic element by first forming an aqueous dispersion of the couplers and then mixing such dispersion with the layer coating solution. An organic solvent is typically used to dissolve the coupler, and the resulting organic solution is then dispersed in an aqueous medium to form the aqueous dispersion.

The organic phase of these dispersions frequently includes high boiling or permanent organic solvents, either alone or with low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Permanent high boiling coupler solvents are primarily used in the conventional "oil-protection" dispersion method whereby the organic solvent remains in the dispersion, and thereby is incorporated into the emulsion layer coating solution and ultimately into the photographic element.

The conventional "oil in water" dispersion method for incorporating hydrophobic couplers is described, e.g., in U.S. Pat. No. 2,322,027 by Jelly and Vittum. In such conventional process, the coupler is dissolved in a high boiling water immiscible solvent, mixed with aqueous gelatin, and dispersed using a colloid mill or homogenizer. The presence of the high boiling solvent provides a stable environment for the hydrophobic coupler, as well as generally increasing the reactivity of the coupler upon photographic processing.

Cyan dye forming couplers dispersed with high boiling organic solvents are well known in the art, including cyan image dye forming couplers of Formula I below, wherein $R_1$ is an alkyl group, $R_2$ is a ballast group, and X is hydrogen or a coupling-off group.

Formula I:

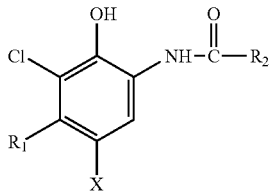

In general, such couplers are relatively easy to synthesize and therefore have low manufacturing costs. However, the reactivity of these couplers and the hue and stability of dyes formed from them can be altered greatly by the nature of the dispersion coupler solvent. Phthalic acid esters such as dibutylphthalate have been found to be very useful as coupler solvents in combination with couplers of Formula I. These coupler solvents enable these couplers to provide high reactivity with oxidized color developer. Such solvents also shift the cyan image dye formed from these couplers bathochromically (to longer wavelengths), which is desirable for color reproduction. They also provide cyan image dyes with adequate light and dark stability. Dibutylphthalate, however, has been identified as possessing potentially undesirable biological properties.

Alternative coupler solvents which deliver all of the desired features with couplers of Formula I must meet a fairly specific set of criteria. In order to deliver high coupler reactivity, alternative solvents must have sufficiently low viscosity. It is also necessary for potential alternative solvents to have sufficient polarity to shift the cyan dye hue bathochromically. It is also important for the solvent to be relatively hydrophobic so that most of it remains present in the layer in which it was coated and is not removed from the coating to an appreciable extent during processing in order to provide good dark stability of cyan image dyes formed from these couplers. Benzoic acid ester or diester solvents are taught in U.S. Pat. No. 6,221,571 as alternative coupler solvents which maintain all of the desirable photographic properties when use with cyan couplers of Formula I, and which are more benign in terms of their potential health and environmental effects. Oleyl alcohol was evaluated in U.S. Pat. No. 6,221,571 as a potential alternative solvent, but was found to result in significantly degraded cyan dye dark stability.

Further, it would be desirable to identify alternative solvents for use with couplers of Formula I which would provide increased activity, so as to enable lower coated levels of materials at equivalent maximum density. The selection of preferred coupler solvents for use with cyan dye forming couplers of Formula I has accordingly required significant exploration and research in order to provide a coupler dispersion with maximum coupler reactivity to minimize coated levels of silver, coupler, and gelatin to reduce materials cost, while providing all of the desired features of the photographic product.

SUMMARY OF THE INVENTION

One embodiment of the invention comprises a silver halide light sensitive photographic element comprising a support bearing at least one cyan image forming hydrophilic colloid layer comprising cyan image dye forming coupler of Formula I and a saturated alcoholic high boiling solvent or mixture of solvents of Formula II:

Formula I

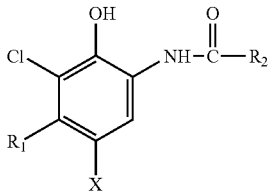

wherein $R_1$ is an alkyl group, $R_2$ is a ballast group, and X is hydrogen or a coupling-off group;

Formula II

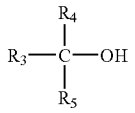

wherein $R_3$ represents an alkyl group, and $R_4$ and $R_5$ individually represent hydrogen or an alkyl group, or $R_3$ and $R_4$ may be joined to form a cycloalkyl group, provided that the total number of carbon atoms contained in $R_3$, $R_4$, and $R_5$ is at least 10 and that the alcoholic solvent or mixture of solvents of Formula II is liquid at 37° C.

ADVANTAGES

The photographic elements of the invention provide high cyan coupler reactivity and form desired cyan dye hues upon photographic processing without degrading cyan dye dark stability. The elements are relatively insensitive to processing developer modifications and employ solvents which are expected to have low undesirable biological effects.

DETAILED DESCRIPTION

The photographic elements of the invention comprise at least one cyan image forming hydrophilic colloid layer comprising cyan image dye forming coupler of Formula I and a saturated alcoholic high boiling solvent or mixture of solvents of Formula II.

In Formula I, $R_1$ represents an alkyl group substituent, which may be linear or branched, and may be substituted or unsubstituted. Preferably, such alkyl group comprises from 2 to 15 carbon atoms, more preferably from 2 to 4 carbon atoms, and most preferably is an ethyl substituent.

$R_2$ represents a ballast group which controls the migration of the coupler when coated in a photographic layer. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to a ballast in the form of a polymeric backbone. Preferred ballast groups include —CHR'—O-Aryl, where R' represents an alkyl group (preferably 1 to 12 carbon atoms) and Aryl represents an aryl substituent (e.g., phenyl) which may be substituted by, e.g., an alkyl, hydroxy, or alkylsulfonamido group, with branched alkyl group substituents such as t-butyl and t-pentyl being preferred.

Coupling-off groups are well known in the art. Such groups can modify the reactivity of the coupler and determine the equivalent number of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Exemplary couplers of Formula I which may be used in an element in accordance with the invention include the following:

C-1

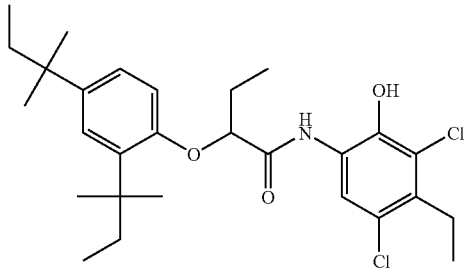

-continued
C-2
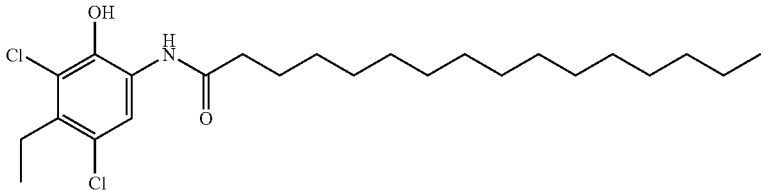
C-3
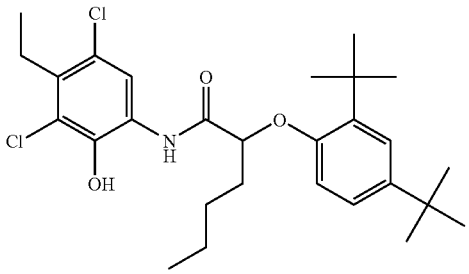
C-4
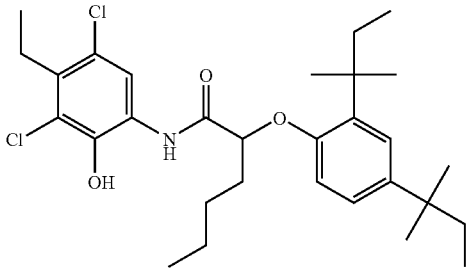
C-5
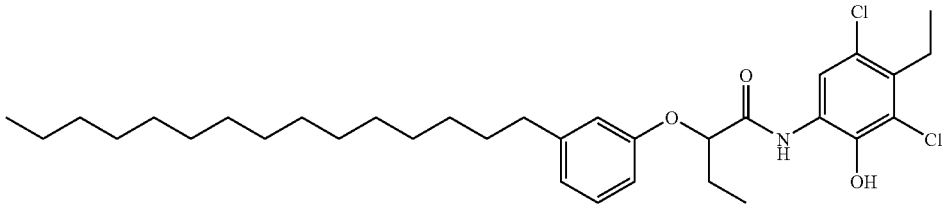
C-6
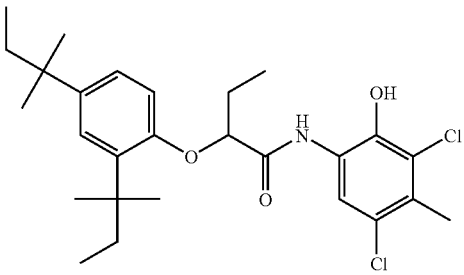
C-7
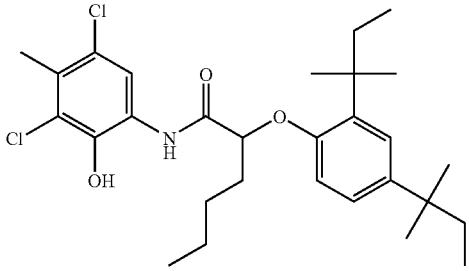

-continued

C-8

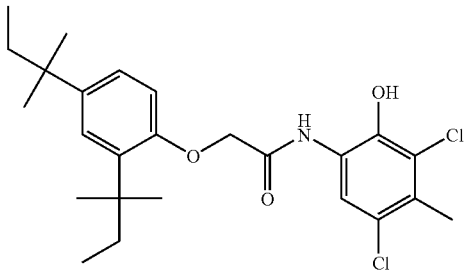

C-9

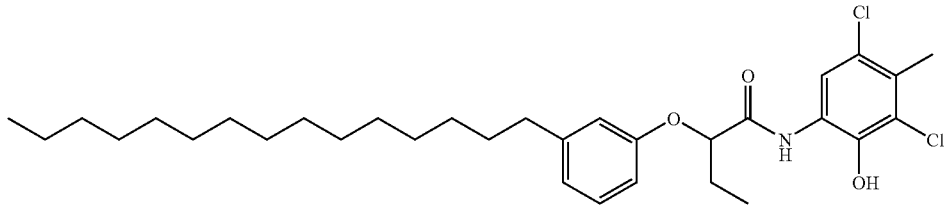

Additional couplers of Formula I which may be used in accordance with the invention include those disclosed in U.S. Pat. Nos. 4,731,320 and 5,009,989, the disclosures of which are hereby incorporated by reference herein.

The term "high boiling solvent" as used herein refers to coupler solvents having a boiling point of above about 150° C. The total number of carbon atoms contained in $R_3$, $R_4$, and $R_5$ of the saturated alcoholic compounds of Formula II is at least 10, and preferably from 10–30, so that the solvent is of sufficient molecular weight to prevent excessive solvent migration between coated photographic element layers. The alcoholic solvent or mixture of solvents of Formula II also is liquid at 37° C., which is a conventional photographic material development process temperature. By requiring the alcoholic solvent or mixture of solvents of Formula II to be liquid at such temperature, improved photographic coupling activity may be achieved during conventional development processes. In accordance with a preferred embodiment of the invention, the saturated alcoholic high boiling solvent or mixture of solvents of Formula II comprises at least one branched chain saturated alcohol of Formula II (i.e., one in which at least one of $R_4$ and $R_5$ individually represents an alkyl group in addition to $R_3$ representing an alkyl group). While some long straight chain aliphatic alcohols may have melting points of greater than 37° C., lower melting points in accordance with the invention may be advantageously obtained for equivalent molecular weight saturated alcohols that comprise branched chain structures. In a further particular embodiment, $R_3$ and $R_4$ may be joined to form a cycloalkyl group.

In accordance with preferred embodiments of the invention, the solvents of Formula II have a viscosity at 25° C. of less than 100 centipoise, more preferably less than 50 centipoise. While use of higher viscosity solvents of Formula II is included within the invention, such solvents should generally be used in solvent blends with lower viscosity solvents in order to provide desired levels of reactivity for couplers of Formula I.

Specific examples of saturated alcoholic compounds of Formula II which may be used in accordance with the invention include the following solvents S-1 through S-13:

S-1: 2-Hexyl-1-decanol

S-2: 1-Tridecanol

S-3: 2-Octyl-1-dodecanol

S-4: 1-Undecanol

S-5: 1-Dodecanol

S-6: 2-Butyl-1-decanol

S-7: 2-Butyl-1-octanol

S-8: 2-Hexyl-1-octanol

S-9: 2-Hexyl-1-dodecanol

S-10: 2-Octyl-1-decanol

S-11: Isomyristyl alcohol

S-12: Isohexadecyl alcohol

S-13: Isooctadecanol

The high-boiling alcoholic compound solvents of Formula II employed in the invention may be commercially available, or may be synthesized by methods known in the art.

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Dispersions of cyan image forming couplers for use in the invention can be prepared by dissolving the couplers in a high boiling solvent of Formula II, or a high boiling solvent blend including at least one solvent of Formula II, optionally with or without low boiling or partially water soluble auxiliary organic solvents. The resulting liquid organic phase may then be mixed with an aqueous gelatin solution, and the mixture is then passed through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. Useful weight ratios of coupler to high-boiling solvent range from about 1:0.1 to 1:8.0, with 1:0.2 to 1:2.0 being typical. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Useful coated levels of the high-boiling saturated alcoholic compound solvents range from about 0.02 to about 5.00 g/sq m, or more typically from 0.05 to 3.00 g/sq m.

While the use of high boiling coupler solvents advantageously improves coupler reactivity in photographic elements, such solvents may also disadvantageously negatively impact the scratch resistance of such elements when incorporated at too high a level. In accordance with a particular embodiment of the invention, solvents of Formula II may be advantageously employed in combination with couplers of Formula I at relatively low total permanent solvent:coupler ratios (e.g., preferably less than 1:1 and more preferably from about 0.1:1 to less than about 0.7:1) in order to provide desired level of activity and improved scratch resistance. In particular, in such relatively low solvent embodiments, greater scratch resistance may be achieved at equivalent activity (e.g., as demonstrated by Dmax values obtained) with the use of solvents of Formula II.

Examples of suitable auxiliary solvents which can be used include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents include ethyl acetate and 2-(2-butoxyethyoxy) ethyl acetate.

The aqueous phase of the coupler dispersions preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

The invention is particularly useful with color photographic print elements, and especially to photographic print elements designed for exposure though a negative film and projection display, such as motion picture print and intermediate films. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure*, December, 1987, Item 17643, published by Industrial Opportunities Ltd., Homewell Havant, Hampshire, P09 1EF, United Kingdom, and *Research Disclosure*, September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

Photographic elements of the invention in accordance with particular embodiments preferably comprise photographic print elements. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure.*" The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically less than 40 mole %), which are also typically substantially free of iodide or contain a very small amount of iodide (e.g., less than 1 mole %). As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art as described above.

Cyan image dye forming couplers of Formula I may be used in combination with other cyan dye forming couplers in elements of the invention, including such couplers as are described in such representative patents and publications as: U.S. Pat. Nos. 2,367,531; 2,423,730; 2,474,293; 2,772,162; 2,895,826; 3,002,836; 3,034,892; 3,041,236; 3,936,303; 4,333,999; 4,609,619; 4,883,746; 5,834,175; and 6,680,165; BP 1,274,523; European Patent Application Nos. 097,042; 102,839; 389,817; 544,322; 556,700; 556,777; 565,096; 570,006; and 574,948; DE 3,624,777; DE 3,700,570; DE 3,936,300; and "Farbkuppler—Eine Literature Ubersicht," published in Agfa Mitteilungen, Band III, pp. 156–175 (1961).

Typical additional cyan couplers are represented by the following formulas:

CYAN-1

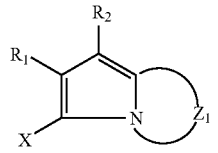

CYAN-2

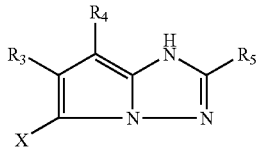

CYAN-3

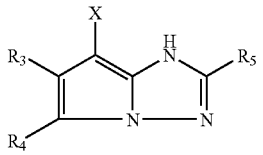

CYAN-4

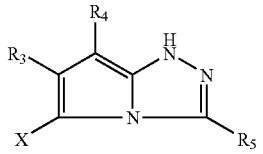

CYAN-5

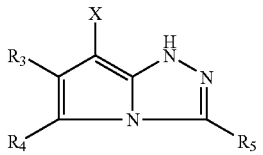

CYAN-6

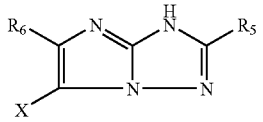

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

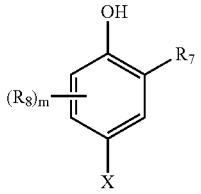

CYAN-8

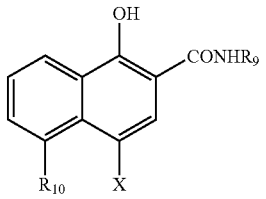

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

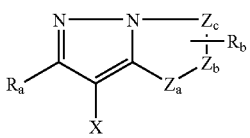

-continued

MAGENTA-2

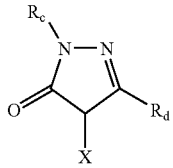

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

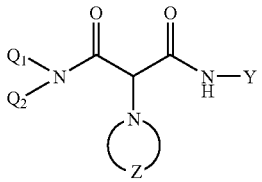

YELLOW-2

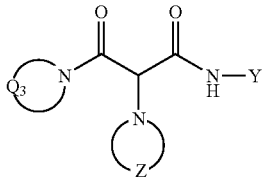

YELLOW-3

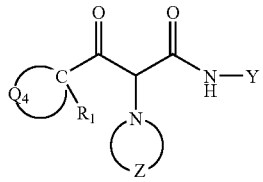

-continued

YELLOW-4

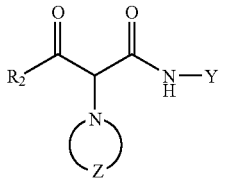

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group.

Typical examples of photographic substituents which may be included in the yellow, cyan and magenta couplers which may be used in the elements of the invention include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

To control the migration of various components coated in a photographic layer, including couplers, it may be desirable to include a high molecular weight hydrophobe or "ballast" group in the component molecule as described above for the cyan couplers.

It may be useful to use a combination of couplers any of which may contain known ballasts or coupling-off groups such as those described in U.S. Pat. Nos. 4,301,235; 4,853,319 and 4,351,897.

If desired, the photographic element can be used in conjunction with an applied magnetic layer as described in *Research Disclosure*, November 1992, Item 34390. It is also specifically contemplated to use photographic elements according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

Photographic elements in accordance with the invention may comprise any conventional support materials, which may be reflective or transparent. Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). In addition to the light sensitive image forming layers described above, the photographic elements of the invention may include further features and layers as are known in the art, including, e.g., antistatic, antihalation, subbing, interlayer, backing, and overcoat layers. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

Photographic elements of the invention preferably comprise an antihalation layer comprising process removable filter dyes or silver. The antihalation layer may be located between the light sensitive layers and the support, or may be positioned on the back side of the support opposite to the light sensitive layers. The filter dyes and/or silver used in antihalation layers are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

The following examples illustrate the preparation of photographic elements in accordance with this invention.

EXAMPLE 1

120.0 g of cyan coupler C-1 was added to 120.0 g of CS-1 (dibutyl sebacate), and 180.0 g of ethyl acetate and heated to 70° C. to completely dissolve the coupler. This oil phase solution was added to an aqueous phase solution consisting of 120.0 g of Type IV gelatin, 90.0 g of a 10% solution of Alkanol XC (Dupont), and 870.0 g of distilled water at 50° C. This mixture was premixed using a Brinkman rotor-stator device at 5000 rpm for 2 min at 50° C. and then passed through a Crepaco homogenizer at 5000 psi. The ethyl acetate was subsequently removed using a rotary evaporator and 10.0 g of 9.24 wt % sulfuric acid and 2.15 g of a 0.7 wt % solution of Kathon LX (Rohm & Haas) and distilled water were added to form Dispersion A, which consisted of 8.0% coupler and 8.0% gel. Dispersions B through H were similarly prepared, except that 120.0 g of a different coupler solvent was used in place of CS-1, as described in Table I. Dispersion A was coated in Layer 4 of the multilayer film structure given below as Coating 1 on a gelatin subbed polyethylene terephthalate support. Additional coating variations are also described in Table I.

| | mg/sq meter |
|---|---|
| Layer 1 | |
| Dye-1 | 129.2 |
| Dye-2 | 56.2 |
| Gelatin | 659 |
| Layer 2 | |
| Blue-sensitive emulsion (3D 0.79 microns, $AgCl_{.995}Br_{.005}$, dyed with sensitizing dye-1 and sensitizing dye-2) | 100.1 |
| Blue-sensitive emulsion (3D 0.42 microns, $AgCl_{.995}Br_{.005}$, dyed with sensitizing dye-1 and sensitizing dye-2) | 314.6 |
| Blue-sensitive emulsion (3D 0.33 microns, $AgCl_{.997}Br_{.003}$, dyed with sensitizing dye-1 and sensitizing dye-2) | 157.3 |
| Coupler Y-1 | 1435 |
| Dye-3 | 40.0 |
| Dye-4 | 4.0 |
| Dye-5 | 26.0 |
| Gelatin | 2480 |
| Layer 3 | |
| Chem-1 | 30.0 |
| Gelatin | 530 |
| Layer 4 | |
| Red-sensitive emulsion (3D 0.22 microns, $AgCl_{.991}Br_{.009}$, dyed with sensitizing dye-3) | 69.6 |
| Red-sensitive emulsion (3D 0.15 microns, $AgCl_{.991}Br_{.009}$, dyed with sensitizing dye-3) | 276.1 |
| Red-sensitive emulsion (3D 0.12 microns, $AgCl_{.990}Br_{.010}$, dyed with sensitizing dye-3) | 118.3 |
| Coupler C-1 | 888 |
| CS-1 | 888 |
| Dye-6 | 86.0 |
| Dye-7 | 52.9 |
| Gelatin | 2837 |
| Layer 5 | |
| Gelatin | 876 |

The above coating further contains sequestrants, antifoggants, surfactants, antistat, matte beads, and lubricants as known in the art. The film also contains hardener at 1.49% of total gelatin. Compound structures not previously identified above are provided at the end of the Examples below.

The elements were exposed through a 0–3 neutral density 21-step tablet on a Kodak 1B sensitometer with a 3200K light source. After exposure, the elements were processed according to the standard Kodak ECP-2B Color Print Development Process as described in the Kodak H-24 Manual, "Manual for Processing Eastman Color Motion Picture Films", Eastman Kodak Company, Rochester, N.Y., the disclosure of which is incorporated by reference herein, with the exception that those steps specific to sound track development were omitted. The process consisted of a pre-bath (10"), water rinse (20"), color developer (3'), stop bath (40"), first wash (40"), first fix (40"), second wash (40"), bleach (1'), third wash (40"), second fix (40"), fourth wash (1"), final rinse (10"), and then drying with hot air.

| The ECP-2B Prebath consists of: | |
|---|---|
| Water | 800 mL |
| Borax (decahydrate) | 20.0 g |
| Sodium sulfate (anhydrous) | 100.0 g |

-continued

| | |
|---|---|
| Sodium hydroxide | 1.0 g |
| Water to make 1 liter | |
| pH @ 26.7° C. is 9.25 +/− 0.10 | |
| The ECP-2B Color Developer consists of: | |
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/− 0.05 | |
| The ECP-2B Stop Bath consists of: | |
| Water | 900 mL |
| Sulfuric acid (7.0N) | 50 mL |
| Water to make 1 liter | |
| pH @ 26.7° C. is 0.90 | |
| The ECP-2B Fixer consists of: | |
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |
| The ECP-2B Ferricyanide Bleach consists of: | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |
| The Final Rinse solution consists of: | |
| Water | 900 mL |
| Kodak Photo-Flo 200 (™) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

The optical density due to dye formation was then measured on a densitometer using filters in the densitometer appropriate to the intended use of the photographic element. Dye density was then graphed versus log (exposure) to form the Red, Green, and Blue D-logE characteristic curves of the photographic elements. The optical density as a function of wavelength was also measured using a Hitachi Model U3410 UV-visible spectrophotometer and the wavelength of maximum absorption (λmax) was recorded to obtain an assessment of cyan dye hue. The maximum red density values and lambda-max values obtained from these coatings are given in Table I.

TABLE I

Effect of Coupler Solvent on Dmax and Dye Hue

| Coating | Dispersion | Solvent(s) | Red Dmax | λmax (nm) |
|---|---|---|---|---|
| 1 (Comp) | A | CS-1 | 3.71 | 660 |
| 2 (Comp) | B | CS-2 | 3.11 | 659 |
| 3 (Comp) | C | CS-3 | 3.64 | 691 |
| 4 (Comp) | D | CS-4 | 3.76 | 668 |
| 5 (Inv) | E | S-1 | 3.84 | 669 |
| 6 (Comp) | F | CS-5 | 3.71 | 693 |
| 7 (Inv) | G | S-2 | 3.81 | 666 |
| 8 (Comp) | H | CS-6 | 3.39 | 681 |

Higher Dmax values are indicative of higher coupler reactivity. High coupler reactivity is desired to minimize the coated levels of silver, coupler, and gelatin to reduce materials cost. In order to obtain good color reproduction a cyan dye hue with a λmax value between 664 nm and 670 nm is required.

The data in Table I illustrate that high Red Dmax values were obtained with all of the solvents used, except CS-2 and CS-6. However, CS-1 and CS-2 provided cyan dye hues that were too hypsochromic, while CS-3, CS-5, and CS-6 produced cyan dye hues that were very bathochromic. Only the alcoholic solvents (CS-4, S-1, and S-2) exhibited acceptable cyan dye hues. As will be further demonstrated below, however, cyan dye dark stability after high temperature treatment has been found to be further degraded with an unsaturated alcoholic solvent (CS-4) compared to saturated alcohols (S-1 and S-2). Additionally, as will also be further demonstrated below, unsaturated alcoholic solvent (CS-4) has also been found to cause decomposition of the coupler during the dispersion making process, which is undesirable. S-1 and S-2 also provided the highest Red Dmax values.

EXAMPLE 2

24.0 g of cyan coupler C-1 was added to 12.0 g of CS-1 (dibutyl sebacate) and 12.0 g of CS-7 (phenylethyl benzoate), and 36.0 g of ethyl acetate and heated to 70° C. to completely dissolve the coupler. This oil phase solution was added to an aqueous phase solution consisting of 24.0 g of Type IV gelatin, 18.0 g of a 10% solution of Alkanol XC (Dupont), and 174.0 g of distilled water at 50° C. This mixture was premixed using a Silverson mixing device at 5000 rpm for 1 min at 50° C. and then passed through a Microfluidizer two times at 5000 psi. The ethyl acetate was subsequently removed using a rotary evaporator and 2.5 g of 9.24 wt % sulfuric acid and 0.3 g of a 0.7 wt % solution of Kathon LX (Rohm & Haas) and distilled water were added to form Dispersion A1, which consisted of 8.0% coupler and 8.0% gel. Dispersions B1 through O1 were similarly prepared, except that 24.0 g of different coupler solvents were used in place of CS-1 and CS-7, as described in Table II. Coatings 9 through 23 were prepared by coating Dispersions A1 through O1 in Layer 4 of the multilayer film structure described in Example 1 and were subsequently exposed and processed as described in Example 1. Maximum Red density values from densitometry readings are reported in Table II below.

TABLE II

Effect of Coupler Solvent on Red Dmax

| Coating | Dispersion | Solvent(s) | Red Dmax |
|---|---|---|---|
| 9 (Comp) | A1 | CS-1/CS-7 (50:50) | 3.79 |
| 10 (Comp) | B1 | CS-8 | 3.38 |
| 11 (Comp) | C1 | CS-1/CS-8 (50:50) | 3.55 |
| 12 (Inv) | D1 | S-1 | 3.82 |
| 13 (Comp) | E1 | CS-15 | 2.05 |
| 14 (Inv) | F1 | S-3 | 3.86 |
| 15 (Comp) | G1 | CS-9 | 3.08 |
| 16 (Comp) | H1 | CS-10 | 3.16 |
| 17 (Comp) | I1 | CS-11 | 3.39 |
| 18 (Comp) | J1 | CS-12 | 3.09 |
| 19 (Comp) | K1 | CS-13 | 3.51 |
| 20 (Inv) | L1 | CS-1/S-1 (20:80) | 3.92 |
| 21 (Comp) | M1 | CS-1/CS-15 (20:80) | 3.47 |
| 22 (Comp) | N1 | CS-8/CS-15 (50:50) | 3.65 |
| 23 (Comp) | O1 | CS-14 | 3.38 |

The data in Table II illustrate that low melting point (i.e., less than or equal to 37° C.) alcoholic solvents (S-1 and S-3) provided the highest Red Dmax values, when used alone or blended with another solvent. Very low Dmax was obtained with CS-15 (1-Hexadecanol), an alcohol that has a melting point of above 37° C., which shows that it is important for the solvent or solvent mixture to be a liquid at developer solution processing temperature. Blends of CS-15 with liquid solvents provided higher Dmax values, but still lower than that obtained with a comparable blend employing a lower melting point alcoholic solvent.

EXAMPLE 3

120.0 g of cyan coupler C-1 was added to 60.0 g of CS-1 (dibutyl sebacate) and 60.0 g of CS-7 (phenylethylbenzoate), and 180.0 g of ethyl acetate and heated to 70° C. to completely dissolve the coupler. This oil phase solution was added to an aqueous phase solution consisting of 120.0 g of Type IV gelatin, 90.0 g of a 10% solution of Alkanol XC (Dupont), and 870.0 g of distilled water at 50° C. This mixture was premixed using a Brinkman rotor-stator device at 5000 rpm for 2 min at 50° C. and then passed through a Crepaco homogenizer at 5000 psi. The ethyl acetate was subsequently removed using a rotary evaporator and 10.0 g of 9.24 wt % sulfuric acid and 2.15 g of a 0.7 wt % solution of Kathon LX (Rohm & Haas) and distilled water were added to form Dispersion A2, which consisted of 8.0% coupler and 8.0% gel. Dispersions B2 through F2 were similarly prepared, except that 120.0 g of different coupler solvents were used in place of CS-1 and CS-7, as described in Table III. Dispersion A2 was coated in Layer 2 of the multilayer film structure given below as Coating 24. Additional coating variations (25–29) are also described in Table III.

| | mg/sq meter |
|---|---|
| Layer 1 | |
| Dye-1 | 129.2 |
| Dye-2 | 56.2 |
| Gelatin | 659 |
| Layer 2 | |
| Red-sensitive emulsion (3D 0.22 microns, $AgCl_{.991}Br_{.009}$, dyed with sensitizing dye-3) | 69.6 |
| Red-sensitive emulsion (3D 0.15 microns, $AgCl_{.991}Br_{.009}$, dyed with sensitizing dye-3) | 276.1 |
| Red-sensitive emulsion (3D 0.12 microns, $AgCl_{.990}Br_{.010}$, dyed with sensitizing dye-3) | 118.3 |
| Coupler C-1 | 888 |
| CS-1 | 444 |
| CS-7 | 444 |
| Dye-6 | 88.0 |
| Gelatin | 2837 |
| Layer 3 | |
| Chem-1 | 30.0 |
| Gelatin | 530 |
| Layer 4 | |
| Green-sensitive emulsion (3D 0.22 microns, $AgCl_{.987}Br_{.013}$, dyed with sensitizing dye-4 and sensitizing dye-5) | 70.3 |

-continued

| | mg/sq meter |
|---|---|
| Green-sensitive emulsion (3D 0.15 microns, $AgCl_{.987}Br_{.013}$, dyed with sensitizing dye-4 and sensitizing dye-5) | 351.3 |
| Green-sensitive emulsion (3D 0.12 microns, $AgCl_{.982}Br_{.018}$, dyed with sensitizing dye-4 and sensitizing dye-5) | 66.4 |
| Coupler M-1 | 642 |
| CS-14 | 140 |
| Chem-1 | 12.0 |
| Dye-5 | 26.0 |
| Dye-7 | 52.9 |
| Gelatin | 1360 |
| Layer 5 | |
| Gelatin | 876 |

The above coating further contains sequestrants, antifoggants, surfactants, antistat, matte beads, and lubricants as known in the art. The film also contains hardener at 1.49% of total gelatin.

Coatings 24 through 29 were subsequently exposed and processed as described in Example 1. The processed coatings were also assessed for cyan dye dark stability from red density losses after 2 week 85° C./50% RH conditions. It is desirable to mimimize the red density loss due to cyan dye fade upon high temperature treatment. The maximum red density values and % red density losses after 2 week 85° C./50% RH from initial red densities of 0.7, 1.0, and 1.6 obtained from these coatings are given in Table III.

TABLE III

Effect of Coupler Solvent on Red Dmax

| Coating | Dispersion | Solvent(s) | Red Dmax | % Red Density Losses from 0.6, 1.0, & 1.7 |
|---|---|---|---|---|
| 24 (Comp) | A2 | CS-1/CS-7 (50:50) | 3.94 | 31%, 32%, 32% |
| 25 (Comp) | B2 | CS-1/CS-4 (50:50) | 4.11 | 32%, 33%, 32% |
| 26 (Inv) | C2 | CS-1/S-1 (50:50) | 4.12 | 29%, 30%, 30% |
| 27 (Comp) | D2 | CS-4 | 4.13 | 39%, 39%, 38% |
| 28 (Inv) | E2 | S-1 | 4.21 | 32%, 35%, 35% |
| 29 (Inv) | F2 | S-2 | 4.13 | 32%, 33%, 32% |

The data in Table III illustrate that higher Dmax values were obtained with all of the coatings (25–29) that employed liquid alcoholic solvents in the cyan coupler dispersion. These data also indicate that cyan dye dark stability after high temperature treatment was further degraded with an unsaturated alcoholic solvent (CS-4) compared to saturated alcohols (S-1 and S-2).

EXAMPLE 4

90.0 g of cyan coupler C-1 and 30.0 g of cyan coupler C-10 were added to 30.0 g of CS-1 (dibutyl sebacate) and 30.0 g of CS-7 (phenylethyl benzoate), and 480.0 g of ethyl acetate and heated to 70° C. to completely dissolve the coupler. This oil phase solution was added to an aqueous phase solution consisting of 120.0 g of Type IV gelatin, 120.0 g of a 10% solution of Alkanol XC (Dupont), and 1100.0 g of distilled water at 50° C. This mixture was premixed using a Silverson mixing device at 5000 rpm for 1 min at 50° C. and then passed through a Microfluidizer one time at 5000 psi. The ethyl acetate was subsequently removed using a rotary evaporator and 2.7 g of a 0.7 wt % solution of Kathon LX (Rohm & Haas) and distilled water was added to form Dispersion A3, which consisted of 4.5% coupler C-1, 1.5% coupler C-10, 3.0% total solvent, and 6.0% gel. Dispersions B3 and C3 were similarly prepared, except that CS-14 and S-1, respectively, were used in place of the CS-1/CS-7 mixture, as described in Table IV. Coatings 30, 31, and 32 were prepared by coating Dispersions A3, B3, and C3 in Layer 4 of the multilayer film structure described in Example 1 and were subsequently exposed and processed as described in Example 1. Maximum Red density values from densitometry readings are reported in Table IV below.

TABLE IV

Effect of Coupler Solvent on Red Dmax

| Coating | Dispersion | Solvent(s) | Red Dmax |
|---|---|---|---|
| 30 (Comp) | A3 | CS-1/CS-7 (50:50) | 4.13 |
| 31 (Comp) | B3 | CS-14 | 3.69 |
| 32 (Inv) | C3 | S-1 | 4.29 |

The data in Table IV show that the highest Red Dmax value was obtained with the solvent of the present invention (S-1).

EXAMPLE 5

80.0 g of cyan coupler C-1 was added to 40.0 g of CS-4 (oleyl alcohol) and 160.0 g of ethyl acetate and heated to 70° C. to completely dissolve the coupler. This oil phase solution was added to an aqueous phase solution consisting of 80.0 g of Type IV gelatin, 60.0 g of a 10% solution of Alkanol XC (Dupont), and 580.0 g of distilled water at 50° C. This mixture was premixed using a Brinkman rotor-stator device at 5000 rpm for 2 min at 50° C. and then passed through a Crepaco homogenizer at 5000 psi. The ethyl acetate was subsequently removed using a rotary evaporator and 10.0 g of 9.24 wt % sulfuric acid and 1.43 g of a 0.7 wt % solution of Kathon LX (Rohm & Haas) and distilled water were added to form Dispersion A4, which consisted of 8.0% coupler and 8.0% gel. Dispersion B4 was similarly prepared, except that 40.0 g of S-1 was used in place of CS-4. Dispersion C4 was prepared like Dispersion A4 except that 80.0 g of CS-4 and 540.0 g of distilled water were employed. Dispersion D4 was prepared like Dispersion C4, except that 80.0 g of S-1 was used in place of CS-4.

The dispersions were analyzed for coupler concentration and coupler decomposition products by High Performance Liquid Chromatography (HPLC) and results are summarized in Table V below.

TABLE V

Coupler Concentration and Decomposition Products by HPLC

| Dispersion | Coupler Solvent | Solvent to Coupler Ratio | Wt % C-1 | Number of Decomp Peaks | Decomp Peaks Total Area % | Dispersion Color |
|---|---|---|---|---|---|---|
| A4 (Comp) | CS-4 | 0.5 | 7.66 | 3 | 1.59 | Pink |
| B4 (Inv) | S-1 | 0.5 | 7.66 | 0 | 0.00 | White |
| C4 (Comp) | CS-4 | 1.0 | 7.54 | 3 | 4.20 | Pink |
| D4 (Inv) | S-1 | 1.0 | 7.72 | 0 | 0.00 | White |

All of the dispersions were approximately 5% low in coupler concentration due to dilution with water from inside of the homogenizer. The data in Table V illustrate that Dispersions A4 and C4, both of which employed CS-1, exhibited unwanted coupler decompostion products, which were not present in Dispersions B4 and D4 of the present invention. Dispersions A4 and C4 were discolored due to the presence of these degradation products. Hence, even though CS-4 provides high coupler reactivity with cyan coupler C-1, it also caused decomposition of the coupler during the dispersion making process, which is undesirable.

EXAMPLE 6

70.0 g of cyan coupler C-1 was added to 35.0 g of CS-1, 35.0 g of CS-7, and 105.0 g of ethyl acetate and heated to 70° C. to completely dissolve the coupler. This oil phase solution was added to an aqueous phase solution consisting of 80.0 g of Type IV gelatin, 60.0 g of a 10% solution of Alkanol XC (Dupont), and 615.0 g of distilled water at 50° C. This mixture was premixed using a Brinkman rotor-stator device at 5000 rpm for 2 min at 50° C. and then passed through a Crepaco homogenizer at 5000 psi. The ethyl acetate was subsequently removed using a rotary evaporator and 10.0 g of 9.24 wt % sulfuric acid and 1.43 g of a 0.7 wt % solution of Kathon LX (Rohm & Haas) and distilled water were added to form Dispersion A5, which consisted of 7.0% coupler and 8.0% gel. Dispersions B5 through D5 were similarly prepared, except that lower permanent solvent levels were employed, as described in Table VI. Dispersions E5 through H5 were prepared like Dispersions A5 through D5, respectively except that a 20:80 blend of CS-1 and S-1 was used in place of the 50: 50 blend of CS-1 and CS-7. Dispersion A5 was coated in Layer 4 of the multilayer film structure given below as Coating 33. Additional coating variations are also described in

TABLE VI

| | mg/sq meter |
|---|---|
| Layer 1 | |
| Dye-1 | 129.0 |
| Dye-2 | 56.0 |
| Gelatin | 759 |
| Layer 2 | |
| Blue-sensitive emulsion (3D 0.79 microns, $AgCl_{.995}Br_{.005}$, dyed with sensitizing dye-1 and sensitizing dye-2) | 124.8 |
| Blue-sensitive emulsion (3D 0.42 microns, $AgCl_{.995}Br_{.005}$, dyed with sensitizing dye-1 and sensitizing dye-2) | 332.8 |
| Blue-sensitive emulsion (3D 0.33 microns, $AgCl_{.997}Br_{.003}$, dyed with sensitizing dye-1 and sensitizing dye-2) | 182.4 |
| Coupler Y-1 | 1340 |
| Dye-3 | 15.0 |
| Dye-4 | 12.0 |
| Dye-5 | 16.0 |
| Gelatin | 2349 |
| Layer 3 | |
| Chem-1 | 30.0 |
| Gelatin | 530 |
| Layer 4 | |
| Red-sensitive emulsion (3D 0.22 microns, $AgCl_{.991}Br_{.009}$, dyed with sensitizing dye-3) | 78.4 |
| Red-sensitive emulsion (3D 0.15 microns, $AgCl_{.991}Br_{.009}$, dyed with sensitizing dye-3) | 258.2 |
| Red-sensitive emulsion (3D 0.12 microns, $AgCl_{.990}Br_{.010}$, dyed with sensitizing dye-3) | 116.4 |
| Coupler C-1 | 868 |
| CS-1 | 434 |
| CS-7 | 434 |
| Dye-6 | 72.0 |
| Dye-7 | 52.9 |
| Gelatin | 2608 |
| Layer 5 | |
| Chem-1 | 30.0 |
| Gelatin | 530 |
| Layer 6 | |
| Green-sensitive emulsion (3D 0.22 microns, $AgCl_{.987}Br_{.013}$, dyed with sensitizing dye-4 and sensitizing dye-5) | 70.4 |
| Green-sensitive emulsion (3D 0.15 microns, $AgCl_{.987}Br_{.013}$, dyed with sensitizing dye-4 and sensitizing dye-5) | 367.2 |
| Green-sensitive emulsion (3D 0.12 microns, $AgCl_{.982}Br_{.018}$, dyed with sensitizing dye-4 and sensitizing dye-5) | 65.4 |
| Coupler M-1 | 642 |
| CS-14 | 140 |
| Chem-1 | 15.0 |
| Dye-7 | 49.5 |
| Gelatin | 1453 |
| Layer 7 | |
| Gelatin | 976 |

The above coating further contains sequestrants, antifoggants, surfactants, antistat, matte beads, and lubricants as known in the art. The film also contains hardener at 1.49% of total gelatin.

Coatings 34 through 40 were prepared by coating Dispersions B5 through H5, respectively in Layer 4 of the multilayer film structure described above and were subsequently exposed and processed as described in Example 1. Scratch resistance (SR) of the emulsion side of the film was measured using a CSM Instruments Pin-On-Disk Tribometer equipped with a 15 mil radius sapphire stylus, which was contacted with the sample under a 1 N normal load while the sample was rotated at a speed of 5 cm/sec for a maximum of 500 laps. The frictional force was monitored using a force transducer. When significant damage to the sample was detected, visually and with the frictional force signal, the experiment was stopped, and the lap number at which failure occurred was recorded. A higher number of laps indicate greater scratch resistance. Maximum Red density values from densitometry readings and scratch resistance data are reported in Table VI below.

TABLE VI

Effect of Reduced Solvent on Red Dmax and Scratch Resistance

| Coating | Dispersion | Solvents | Solvent/ Coupler | Red Dmax | SR (laps) |
|---|---|---|---|---|---|
| 33 (Comp) | A5 | CS-1/CS-7 | 1.0 | 4.14 | 58 |
| 34 (Comp) | B5 | CS-1/CS-7 | 0.6 | 3.89 | 105 |
| 35 (Comp) | C5 | CS-1/CS-7 | 0.4 | 3.63 | 209 |
| 36 (Comp) | D5 | CS-1/CS-7 | 0.2 | 3.28 | 500 |
| 37 (Inv) | E5 | CS-1/S-1 | 1.0 | 4.20 | 19 |
| 38 (Inv) | F5 | CS-1/S-1 | 0.6 | 4.13 | 88 |
| 39 (Inv) | G5 | CS-1/S-1 | 0.4 | 3.97 | 144 |
| 40 (Inv) | H5 | CS-1/S-1 | 0.2 | 3.58 | 463 |

The data in Table VI show that higher Dmax values were maintained with the inventive solvents as total coupler solvent was reduced. The results also indicate that scratch resistance was improved as total solvent was reduced. Greater scratch resistance was achieved at equivalent Dmax values with the inventive solvents.

EXAMPLE 7

80.0 g of cyan coupler C-1 was added to 9.6 g of CS-1 and 38.4 g of S-1, and 117.0 g of ethyl acetate and heated to 70° C. to completely dissolve the coupler. This oil phase solution was added to an aqueous phase solution consisting of 80.0 g of Type IV gelatin, 62.5 g of a 10% solution of Alkanol XC (Dupont), and 612.5 g of distilled water at 50° C. This mixture was premixed using a Brinkman rotor-stator device at 5000 rpm for 2 min at 50° C. and then passed through a Crepaco homogenizer at 5000 psi. The ethyl acetate was subsequently removed using a rotary evaporator and 10.4 g of 9.24 wt % sulfuric acid and 1.43 g of a 0.7 wt % solution of Kathon LX (Rohm & Haas) and distilled water were added to form Dispersion A6, which consisted of 8.0% coupler and 8.0% gel. Dispersion A6 was coated in Layer 2 of the multilayer film structure described in Example 3, replacing Dispersion A2 (at equivalent coupler C—I laydown), and is given below as Coating 41. Coating 42 was similarly prepared, except that CS-14 was replaced with CS-1 in Layer 4, as described in Table VII below. Coatings 41 and 42 were subsequently exposed and processed as described in Example 1. The processed coatings were also assessed for thermal yellowing from blue density increases after 4 week 60° C./50% RH conditions. It is desirable to mimimize the blue density gain upon high temperature treatment. The blue density values before and after subjecting the coatings to 4 week 60° C./50% RH conditions are given in Table VII.

TABLE VII

Effect of Magenta Dispersion Solvent on Thermal Yellowing

| Coating | Cyan Layer Dispersion (Layer 2) | Magenta Layer Coupler Solvent (Layer 4) | Blue Density After Processing | Blue Density After 4 Wk 60° C./50% RH |
|---|---|---|---|---|
| 41 (Inv) | A6 | CS-14 | 0.027 | 0.125 |
| 42 (Inv) | A6 | CS-1 | 0.027 | 0.097 |

These data illustrate that CS-1 is a preferred solvent for magenta coupler M-1 in combination with the cyan coupler dispersion of the present invention to minimize thermal yellowing of the processed coating after high temperature treatment.

Additional Compound Structures:

Dye-1

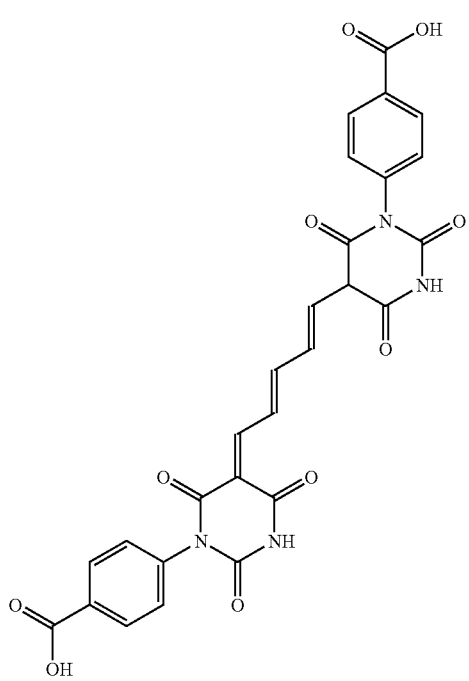

Dye-2

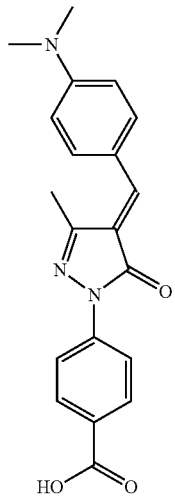

-continued
Dye-3
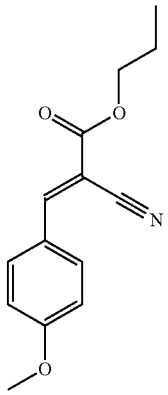
Dye-4
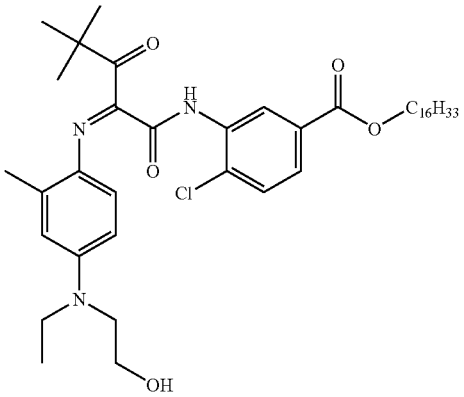
Dye-5
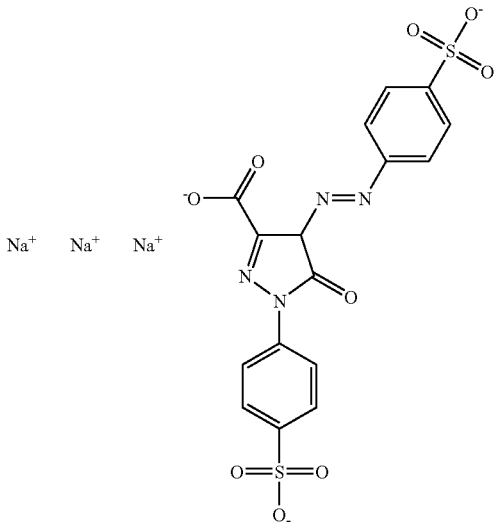
-continued
Dye-6
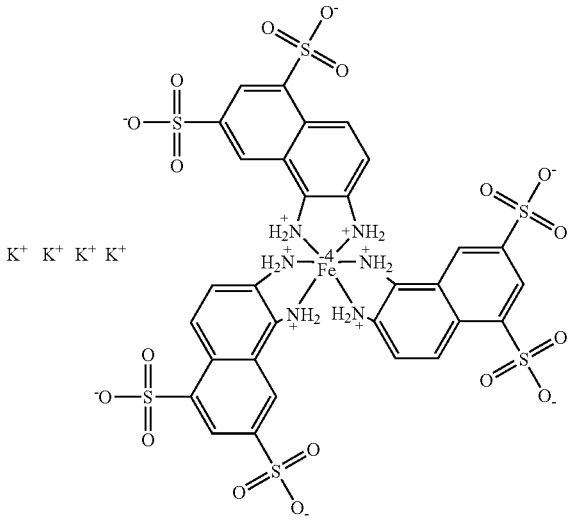
Dye-7
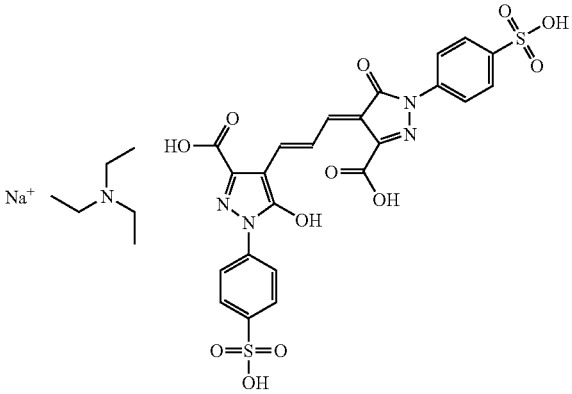
Sensitizing Dye-1
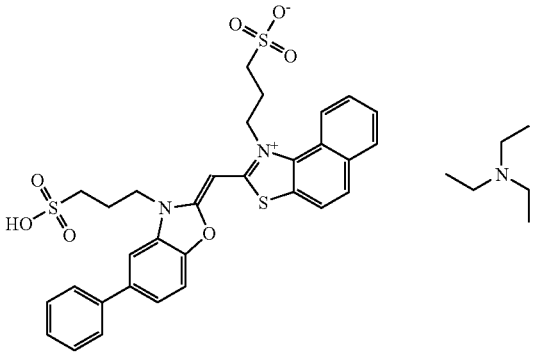

-continued
Sensitizing Dye-2
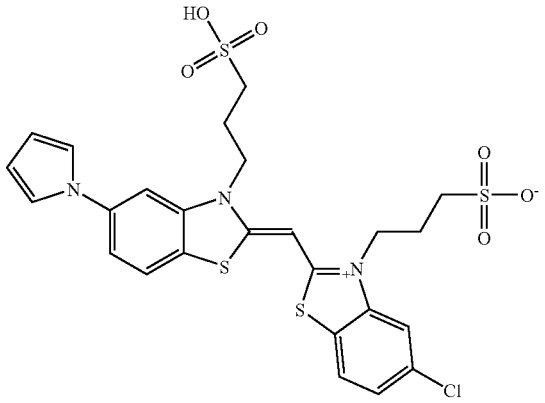
Sensitizing Dye-3
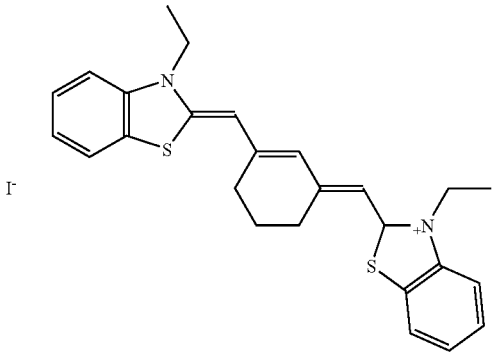
Sensitizing Dye-4
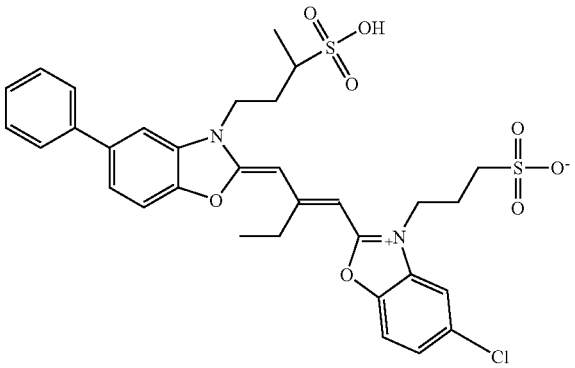
Sensitizing Dye-5
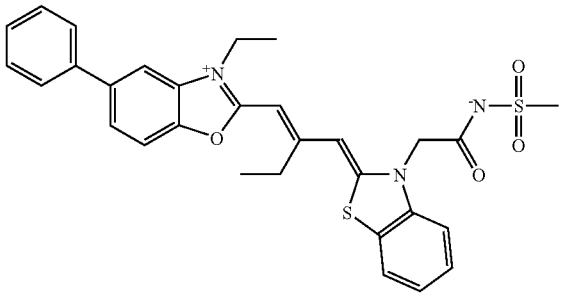
-continued
Chem-1
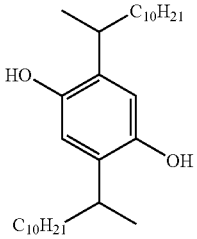
Coupler Y-1
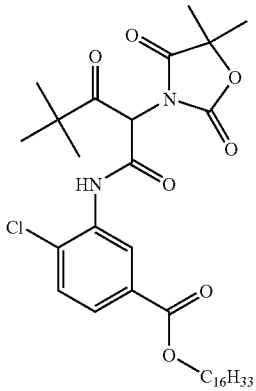
Coupler C-1
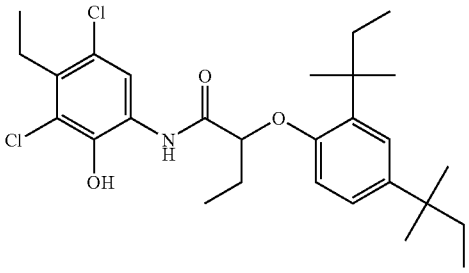
Coupler C-10
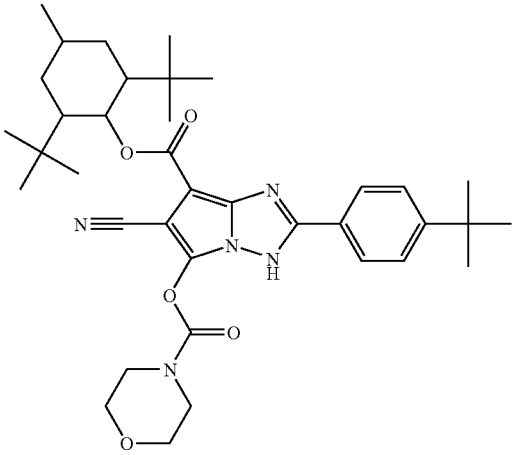

-continued
Coupler M-1
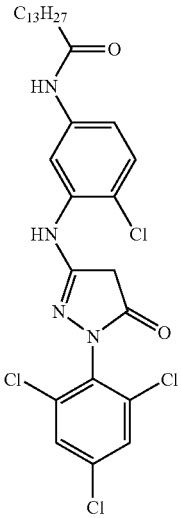
CS-1
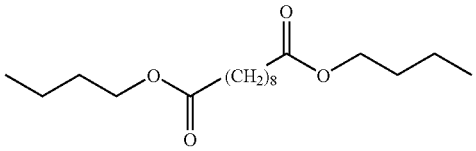
CS-2
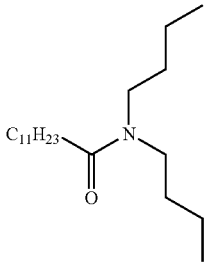
CS-3
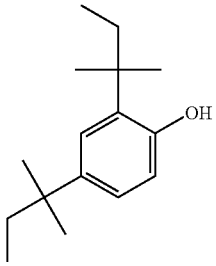
CS-4
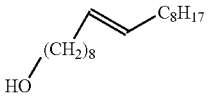
CS-5
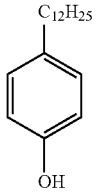
-continued
CS-6
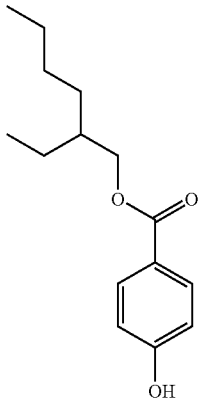
CS-7
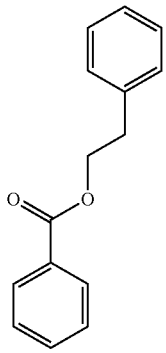
CS-8
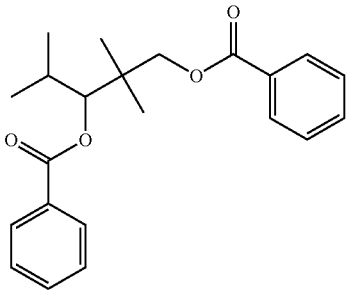
CS-9: Nonyl-4-hydroxybenzoate
CS-10: Dodecyl-4-hydroxybenzoate
CS-11: m-Pentadecylphenol
CS-12
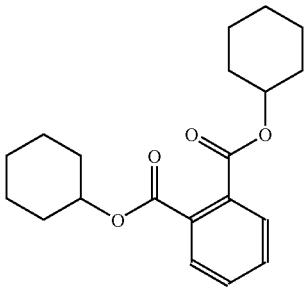

CS-13: Tri-phenylphosphate

CS-14: Tri-cresylphosphate

CS-15: 1-Hexadecanol

This invention has been described in detail with particular reference to preferred embodiments thereof. It will be understood that variations and modifications can be made within the spirit and scope of the invention.

The invention claimed is:

1. A silver halide light sensitive color photographic print element comprising a support bearing at least one cyan image forming hydrophilic colloid layer comprising cyan image dye forming coupler of Formula I and a saturated alcoholic high boiling solvent or mixture of solvents of Formula II:

Formula I

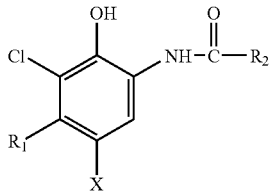

wherein $R_1$ is an alkyl group, $R_2$ is a ballast group, and X is hydrogen or a coupling-off group;

Formula II

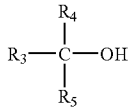

wherein $R_3$ represents an alkyl group, and $R_4$ and $R_5$ individually represent hydrogen or an alkyl group, or $R_3$ and $R_4$ may be joined to form a cycloalkyl group, provided that the total number of carbon atoms contained in $R_3$, $R_4$, and $R_5$ is at least 10 and that the alcoholic solvent or mixture of solvents of Formula II is liquid at 37° C.

2. A silver halide light sensitive color photographic color element comprising a support bearing in sequential order on one side thereof at least one yellow image forming hydrophilic colloid layer comprising a blue-sensitive silver halide emulsion and yellow image dye forming coupler, at least one cyan image forming hydrophilic colloid layer comprising red-sensitive silver halide emulsion and cyan image dye forming coupler, and at least one magenta image forming hydrophilic colloid layer comprising green-sensitive silver halide emulsion and magenta image dye forming coupler; wherein the cyan image forming hydrophilic colloid layer comprises cyan image dye forming coupler of Formula I and a saturated alcoholic high boiling solvent or mixture of solvents of Formula II:

Formula I

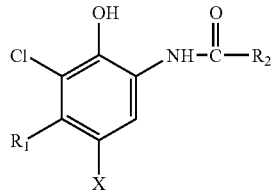

wherein $R_1$ is an alkyl group, $R_2$ is a ballast group, and X is hydrogen or a coupling-off group;

Formula II

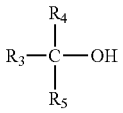

wherein $R_3$ represents an alkyl group, and $R_4$ and $R_5$ individually represent hydrogen or an alkyl group, or $R_3$ and $R_4$ may be joined to form a cycloalkyl group, provided that the total number of carbon atoms contained in $R_3$, $R_4$, and $R_5$ is at least 10 and that the alcoholic solvent or mixture of solvents of Formula II is liquid at 37° C.

3. A photographic element according to claim 2, wherein the saturated alcoholic high boiling solvent or mixture of solvents of Formula II comprises at least one compound wherein at least one of $R_4$ and $R_5$ represents an alkyl group.

4. A photographic element according to claim 2, wherein the saturated alcoholic high boiling solvent or mixture of solvents of Formula II comprises at least one compound wherein $R_3$ and $R_4$ are joined to form a cycloalkyl group.

5. A photographic element according to claim 2, wherein the total number of carbon atoms contained in $R_3$, $R_4$, and $R_5$ is from 10–30.

6. A photographic element according to claim 2, wherein the viscosity of the alcoholic solvent or mixture of solvents of Formula II at 25° C. is less than 50 centipoise.

7. A photographic element according to claim 2, wherein the alcoholic solvent or mixture of solvents of Formula II comprises: 2-Hexyl-1-decanol.

8. A photographic element according to claim 2, wherein the alcoholic solvent or mixture of solvents of Formula II comprises: 1-Tridecanol.

9. A photographic element according to claim 2, wherein the alcoholic solvent or mixture of solvents of Formula II comprises: 2-Octyl-1-dodecanol.

10. A photographic element according to claim 2, wherein the cyan image forming hydrophilic colloid layer comprises coupler of Formula I and solvent or mixture of solvents of Formula II in a coupler:solvent weight ratio of from 1:0.1 to 1:0.7.

11. A photographic element of claim 2, having an effective ISO speed rating of less than about 10.

12. A photographic element of claim 2, wherein each of the blue-sensitive, red-sensitive and green-sensitive silver halide emulsions comprise silver halide emulsion grains comprising greater than 50 mole % chloride based on total silver.

13. A photographic element of claim 12, wherein the silver halide emulsion grains have an average equivalent circular diameter of less than 1 micron and an aspect ratio of less than 1.3.

14. A photographic element of claim 12, wherein each of the red-sensitive and green-sensitive silver halide emulsions comprise emulsion grains having an average equivalent circular diameter of less than 0.60 micron, and the blue-sensitive silver halide emulsion comprises emulsion grains having an average equivalent circular diameter of less than 0.90 micron.

15. A photographic element of claim 2, wherein $R_1$ represents an ethyl substituent.

16. A photographic element of claim 15, wherein X represents a chloro substituent.

17. A photographic element of claim 16, wherein $R_2$ represents —CHR'—O-Aryl, where R' represents an alkyl group of from 1 to 12 carbon atoms and Aryl represents an aryl substituent.

18. A motion picture color print film element comprising a transparent polymeric film support bearing in sequential order on one side thereof at least one yellow image forming hydrophilic colloid layer, at least one cyan image forming hydrophilic colloid layer, and at least one magenta image forming hydrophilic colloid layer according to claim 2.

* * * * *